US008098156B2

(12) United States Patent
Caler et al.

(10) Patent No.: US 8,098,156 B2
(45) Date of Patent: Jan. 17, 2012

(54) SECURITY SYSTEM WITH ACTIVITY PATTERN RECOGNITION

(75) Inventors: Dennis M Caler, Marion, NY (US); David L Anderson, Rochester, NY (US); Jeffrey M Swan, Rochester, NY (US)

(73) Assignee: Robert Bosch GmbH, Stuttgart (DE)

( * ) Notice: Subject to any disclaimer, the term of this patent is extended or adjusted under 35 U.S.C. 154(b) by 598 days.

(21) Appl. No.: 12/229,571

(22) Filed: Aug. 25, 2008

(65) Prior Publication Data

US 2010/0045461 A1 Feb. 25, 2010

(51) Int. Cl.
*G08B 13/00* (2006.01)

(52) U.S. Cl. ..... 340/541; 340/500

(58) Field of Classification Search ..... 340/541
See application file for complete search history.

(56) References Cited

U.S. PATENT DOCUMENTS 4,760,393 A 7/1988 Mauch
6,796,799 B1 9/2004 Yoshiike et al.
7,002,463 B2 * 2/2006 Wakabayashi ..... 340/522
7,298,253 B2 11/2007 Petricoin et al.
2003/0053659 A1 3/2003 Pavlidis et al.
2005/0125403 A1 * 6/2005 Wakabayashi ..... 707/6
2005/0181771 A1 8/2005 Cuddihy et al.
2005/0278409 A1 * 12/2005 Kutzik et al. ..... 709/200
2005/0286686 A1 * 12/2005 Krstulich ..... 379/32.01
2006/0227001 A1 * 10/2006 Petricoin et al. ..... 340/815.4

OTHER PUBLICATIONS

Bosch Security Systems, Inc., Easy Series User's Guide-Intrusion Control Panel, 8 pages, 2006.

Bosch Security Systems, Inc., Easy Series Intrusion Control Panel-Making Security Easy, 8 pages.

* cited by examiner

*Primary Examiner* — Travis Hunnings
(74) *Attorney, Agent, or Firm* — Baker & Daniels LLP

(57) ABSTRACT

A security system and method of operation thereof stores information related to a plurality of detected events and determines an activity pattern based on the stored information. The system and method then determines a type of alarm, if any, to issue in response to a detected trigger event based at least in part on the determined activity pattern.

20 Claims, 4 Drawing Sheets

SECURITY SYSTEM WITH ACTIVITY PATTERN RECOGNITION

FIELD OF THE INVENTION

The present invention relates to surveillance systems that issue alarm signals. More particularly, the present invention relates to reducing the issuance of false alarm signals by surveillance systems.

BACKGROUND AND SUMMARY OF THE INVENTION

Surveillance systems, also known as security systems, may include security devices such as motion detectors or cameras for monitoring interior portions of a secured area of space, door sensors and window sensors for monitoring perimeter portions of the secured area of space, or other suitable types of sensors. When one of these sensors detects motion and/or the opening of a monitored door or window, the security system may issue an alarm signal that causes a siren to produce an audible alarm. The alarm signal may also be electronically communicated to a security company. The security company typically notifies the police, who may then visit the secured area of space in order to investigate.

A problem is that many of the alarm signals issued by a security system are what are known as "false alarms". False alarms are not the result of a genuinely dangerous condition, such as the presence of an intruder, but rather are a result of a resident, employee of the building, or other user moving within the secured area of space and inadvertently causing an alarm signal to be issued. Investigations of the false alarms by the police are a waste of community resources and may result in the owners of the security system being monetarily fined.

An approach to reducing the false alarm problem is known as "entry or exit delay", in which some time period is provided by the security system to allow the user to enter a passcode or other identification to thereby abort an alarm signal, as mentioned above. Most security systems employ an entry delay period which begins when the initial entry door is violated. Often, the security system communicates with the user to prompt the user to abort the alarm signal. The user needs to disarm the system within a programmed time period in order to avoid a false alarm. That is, if the system is not disarmed within the given time period, an alarm response will begin.

Another approach is known as "dialer delay", which delays the sending of an alarm signal to a monitoring station for a predetermined time period. This gives the user time to cancel the alarm before emergency service personnel are dispatched. The delay period typically begins when an alarm condition has been detected. The security system will delay the sending of an alarm signal to the central station for a programmed period of time. If the alarm condition is not acknowledged within the given time period, the security system will send a report to a central station.

In conventional security systems, time periods in which the security system is turned on (armed) or turned off (disarmed) may be programmed by a user, system administrator or manufacturer. Time periods for the entry and exit delays or dialer delays may also be programmed into the system. As activity patterns of users changes, these preprogrammed times may cause an increase in false alarms.

The present invention reduces false alarms in a security system by monitoring activity within a premises over time and learning the typical movements of users and the associated time of day, day of week, and security zones of such movements. Such activity monitoring allows for natural adjustments to, for example, arming and disarming times, entry and exit delay times, dialer delay times or other processing times that are fixed (programmable) in many conventional security systems.

As discussed above, conventional security systems use programmable windows of time for entry and exit delays in conjunction with arming/disarming the system. If an alarm occurs during the arming/disarming sequence then an "unverified" type of alarm may be activated to indicate that the alarm was likely caused by a user and not a true intruder. Cross-zoning is another approach that is used for patterns. In cross-zoning, if two or more zones are alarmed in a particular order (programmable) then an alarm will be sent. Typically no alarm (or an "unverified" alarm) is sent unless the cross-zoning alarm sequence is correct.

The present system and method reduces the need to program a security system with specific times for arming/disarming to help in false alarm reduction. The present system and method monitors and tracks typical movement patterns of users and the associated time of day, and day of week, and/or zone of movement so that upfront programming of the system is not required. In addition, reprogramming is not required in the event of a change of habits or activity patterns by the users. The learned information (such as the zone that was violated, time of day, and/or day of the week) is stored and updated over time. Based on the stored learned information, the present system determines whether or not to issue an alarm in response to a trigger event, and if so, what type of alarm signal to send to a central station or other location.

In an illustrated embodiment of the present invention, a method of operating a security system comprises providing a plurality of sensors configured to sense trigger events and generate detection signals based thereon, detecting a plurality of events that occur within the security system, and storing information related to the plurality of detected events in a recent activity database. The method also comprises determining an activity pattern based on the stored information related to the plurality of detected events, detecting a trigger event based on a detection signal from at least one of the plurality of sensors, and determining a type of alarm, if any, to issue in response to the detected trigger event based at least in part on the determined activity pattern.

In an illustrated embodiment, an unverified alarm is issued if the trigger event is within an acceptable activity pattern. The unverified alarm gives a user a predetermined time period to cancel the unverified alarm. Also in an illustrated embodiment, a verified alarm is issued if the trigger event is not within an acceptable activity pattern. The verified alarm is typically sent directly to at least one of a central monitoring station, a security company, a fire station and a police station.

Also in an illustrated embodiment, the method further comprises automatically programming at least one time window to determine whether an unverified alarm may be issued in response to a trigger event based at least in part on the determined activity pattern. The illustrated method further comprises automatically programming times for arming and disarming the security system based at least in part on the determined activity pattern.

In another illustrated embodiment of the present invention, a security system comprises a plurality of sensors configured to sense trigger events and generate detection signals based thereon, a controller configured to receive the detection signals from the plurality of sensors and selectively generate an alarm signal in response to the detection signals, and a recent activity database accessible by the controller. The recent activity database stores information related to a plurality of events occurring during operation of the security system. The controller is programmed to determine an activity pattern based on the information related to the plurality of events stored in recent activity database and determine a type of alarm, if any, to issue in response to a detected trigger event based at least in part on the determined activity pattern.

In an illustrated embodiment, the controller issues an unverified alarm if the detected trigger event is within an acceptable activity pattern, and the controller issues a verified alarm if the detected trigger event is not within an acceptable activity pattern. The unverified alarm gives a user a predetermined time period to cancel the unverified alarm. The verified alarm is typically sent directly to at least one of a central monitoring station, a security company, a fire station and a police station.

Additional features of the present invention will become apparent to those skilled in the art upon consideration of the following detailed description of illustrative embodiments exemplifying the best mode of carrying out the invention as presently perceived.

BRIEF DESCRIPTION OF THE DRAWINGS

The above mentioned and other features and objects of this invention, and the manner of attaining them, will become more apparent and the invention itself will be better understood by reference to the following description of illustrated embodiments of the invention taken in conjunction with the accompanying drawings, wherein.

DETAILED DESCRIPTION OF THE DRAWINGS

Figure 1:
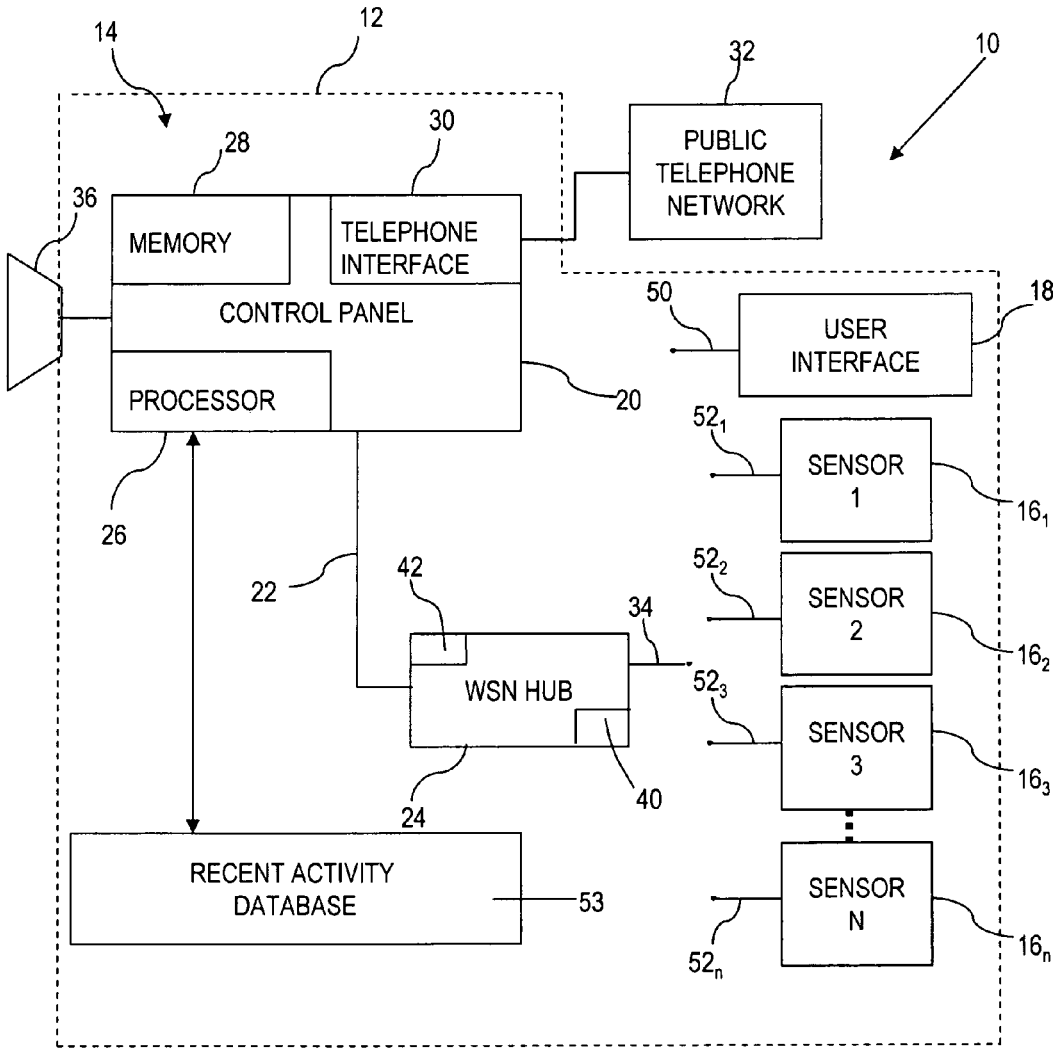
FIG. 1 is a block diagram of one embodiment of a security system of the present invention.

Before embodiments of the invention are explained in detail, it is to be understood that the invention is not limited in its application to the details of the examples set forth in the following description or illustrated in the drawings. The invention is capable of other embodiments and of being practiced or carried out in a variety of applications and in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "connected" and/or "coupled" are used broadly and encompass both direct and indirect mounting, connecting, and coupling.

Referring now to the drawings, FIG. 1 illustrates one embodiment of a security system 10 of the present invention for a structure 12 such as a building. However, system 10 may be used to secure other spaces, such as outdoor areas, subterranean rooms and passages, and zones of air space. System 10 includes a system controller 14, security sensors $\mathbf{16}_1$ through $\mathbf{16}_n$, and at least one user interface 18. Multiple user interfaces 18 may be spaced throughout a building 12, if desired.

System controller 14 includes a control device in the form of a control panel 20 which may be electrically connected via an communication bus 22 to a wireless sensor network (WSN) hub 24. Control panel 20 may include a processor 26, a memory device 28 and a telephone or other communication interface 30. Processor 26 may coordinate communication with the various system components including WSN hub 24 and an audible alarm 36 associated with building 12. Memory 28 may include software for interpreting signals from sensor devices 16 and user interface 18, and deciding based thereon whether to initiate an alarm signal from control panel 20. The alarm signal may be used to activate audible alarm 36, or to notify a central station receiver (CSR) (not shown) such as a security company, fire station, or police station, for example, via public telephone network 32 or other communication channel. After control panel 20 initiates an alarm signal, the alarm signal may be transmitted immediately to alarm 36 and/or to the CSR. Alternatively, after control panel 20 initiates an alarm signal, there may be a delay before the alarm signal is transmitted in order to provide the user time to abort the alarm signal transmission by entering a passcode in user interface 18 or by using another suitable user identification device 54 discussed in FIG. 2 below. Memory 28 may also store identification information for sensors 16 such that control panel 20 may determine by analyzing a received signal which of sensors 16 transmitted the signal.

WSN hub 24 may include an antenna element 34 for transmitting and receiving air-borne signals, such as radio frequency signals. The radio frequency signals may be received by and transmitted from, i.e., exchanged with, sensors 16 and user interface 18. Information from sensors 16 and user interface 18 may be passed by WSN hub 24 to control panel 20 via bus 22. Control panel 20 may pass information to WSN hub 24 via bus 22 for transmission to sensors 16 and user interface 18 as necessary. WSN hub 24 may include a processor 40 and memory 42 for storing software and identification information associated with sensors 16 and user interface 18.

Sensors 16 may be in the form of any number or combination of perimeter sensors, such as window sensors and/or door sensors, and interior sensors, such as motion detectors and/or cameras. The window sensors may detect the opening and/or closing of a corresponding window (not shown) of building 12. The door sensors may detect the opening and/or closing of a corresponding door (not shown) of building 12. Door sensors are traditionally treated as "delay" sensors in that, after the door sensor detects that the corresponding door has been opened, there is a delay before the alarm signal is transmitted in order to provide the user time to abort the alarm signal transmission by entering a passcode in user interface 18 or using another suitable identification device 54. Conversely, window sensors are traditionally treated as "instant" sensors in that, after the window sensor detects that the corresponding window has been opened, the alarm signal is transmitted immediately. However, it is also within the scope of the present invention for window sensors to be treated as "delay" sensors. The motion sensors or cameras may each detect movement within a corresponding interior zone of the secured area, and are traditionally treated as "instant" sensors. However, again, it is possible for motion sensors and/or cameras to be treated as "delay" sensors.

Each sensor 16 may be wireless and may include a respective antenna element 52 for transmitting and receiving air-borne signals, such as radio frequency signals. The radio frequency signals may be received by and transmitted from, i.e., exchanged with, WSN hub 24. For example, each sensor 16 may send a detection signal to control panel 20 via hub 24 each time the sensor senses a security breach.

Processor 26 also stores detected information from the sensors 16 and user interfaces 18 in a recent activity database 53. Therefore, system 10 monitors and tracks information related to typical user activity patterns such as zones of movement and/or violation, along with the time of day and day of the week of such activity. The activity pattern information is stored in recent activity database 53 and further processed to modify operation of the security system 10 as discussed below.

Figure 2:
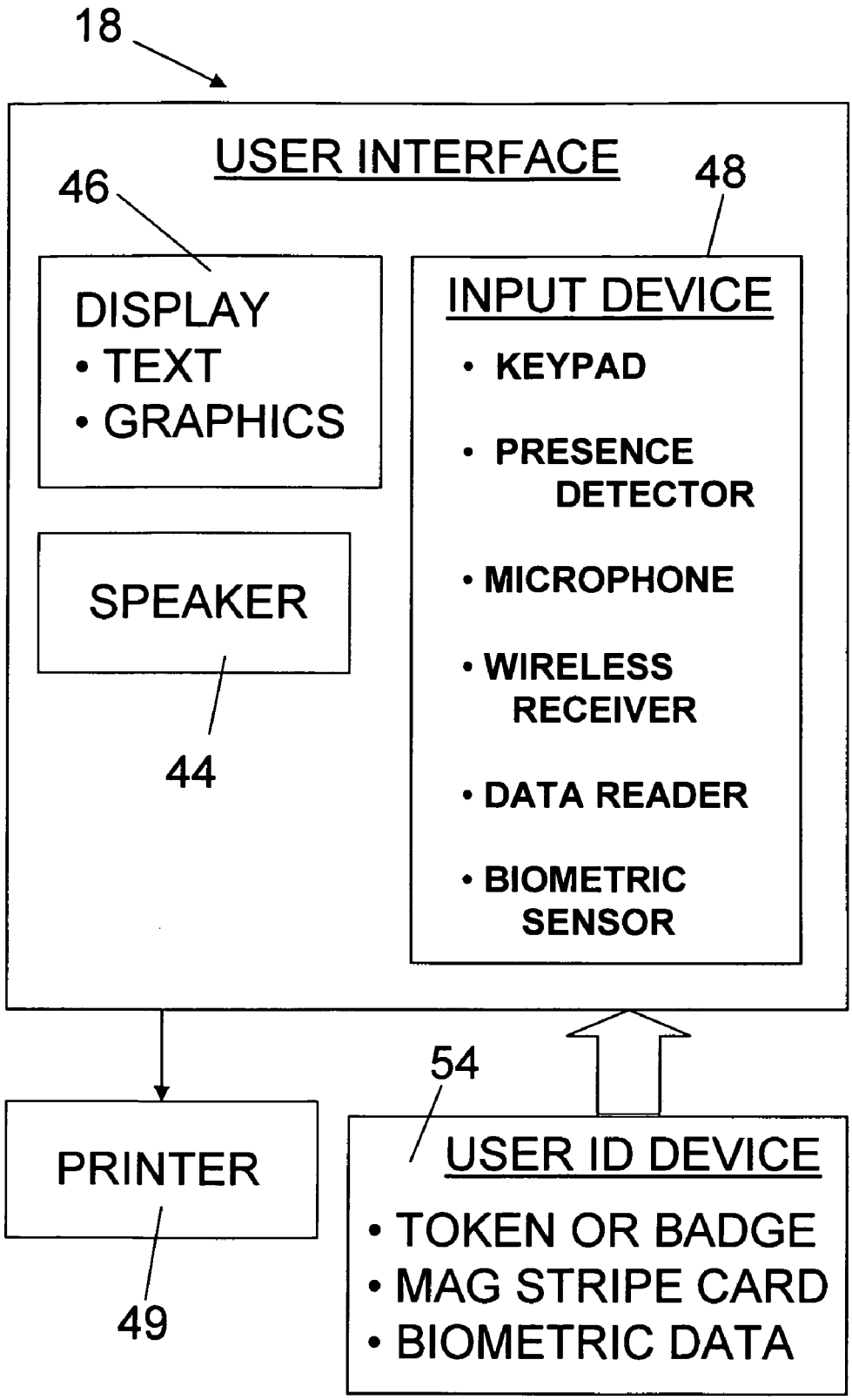
FIG. 2 is block diagram illustrating components of a user interface and a user identification device in accordance with an illustrated embodiment of the present invention.

User interfaces 18 may be wireless and may include an antenna element 50 for exchanging air-borne signals with WSN hub 24. As shown in FIG. 2, an illustrated user interface 18 may include a speaker 44, a visual display 46 such as liquid crystal diode (LCD) or other type of display 46, and at least one input device 48. Input device 48 may include a keypad, a presence detector, a microphone, a wireless receiver, a data reader, a biometric sensor or other input that enables the user to program or enter data to control the security system 10.

Speaker 44 is capable of producing audible tones and/or audible spoken words that are intended to be heard by a user of security system 10. The content of the audio communications may be transmitted by control panel 20 to user interface 18 for broadcast by speaker 44. The content may also be generated locally at user interface 18.

As discussed above, when an alarm is triggered there may be a delay period to permit a user to abort the alarm. It is to be understood that the delay period may have any duration selected by a system administrator and/or made available by the manufacturer of security system 10. The time duration of the entry delay period may typically be between approximately 20 seconds and approximately 90 seconds. The delay period may be adjusted automatically by the system 10 depending on activity patterns detected.

During an entry or exit delay period, indicating devices including siren 36, speaker 44, display 46 and printer 49 may provide indications to the user that an alarm signal will be issued in response to a detection signal from one or more of sensors 16. User interface 18 may audibly provide spoken word information to the user to explain the significance of the audible siren pulse. The spoken word information may also direct the user as to what actions the user should take to abort the alarm. For example, a spoken word announcement from speaker 44 may state, "To turn off your system, present your token or enter your passcode".

User interface 18 may communicate with a user identification device 54 also shown in FIG. 2. The user identification device 54 may be any suitable device for identifying the particular user. For instance, user identification device 54 may be an RFID token, a badge having a wireless transmitter (IR or RF), a magnetic stripe card, or biometric data available from the user.

In one illustrated embodiment, an RFID tag, an IR or RF badge, or other identification device may be used to identify the user to the system without the user having to manually input any information into the system. Therefore, as the user is passing an area adjacent the user interface 18, the input device 48 automatically detects the presence of the particular user. For instance, the user may wear a wireless transmitter identification badge which includes the RFID token, an IR or RF transmitter, or other identification device which is automatically detected by a data reader of input device 48. Therefore, the user interface 18 may identify the particular user and begin communicating with the particular user in the user's preferred language even before the authentication data is entered via the keypad or other input device 48. The security system 10 may interface with other locating and tracking systems that monitor the location of individuals in a building. Such locating and tracking information may be stored in the recent activity database.

The following terms used herein have the following definitions:

A "trigger event" is an event that occurs at sensor, such as a motion detector, camera, door window contact, or other sensor that indicates a change of state or other security breach.

An "alarm event" is a trigger event in the armed state that is not within an acceptable activity pattern.

An "arm event" is an event that turns the security system on and puts it in an armed state.

A "disarm event" is an event that turns the security system off and puts it in a disarmed state.

A "recent event database" is a database storing recent event or activity information related to the security system.

An "activity pattern" is a learned sequence or pattern of events that occur at times determined based on the recent event database.

An "armed state" is when the security system is "on".

A "disarmed state" is when the security system is "off".

As discussed above, the security system 10 and method of operation of the present invention uses activity pattern recognition to self-learn normal activity patterns of users within a protected premises such as building 12. Such activity patterns include, for example, tracking the day of week, time of day, and the particular zone or sensor that was violated for the purpose of determining normal arming and disarming patterns of the security system 10. The present system and method uses this learned information to determine how to react to a sensor signal or trigger event indicating a possible intrusion. For instance, the self-learned information of the present invention is used to determine whether a trigger event should cause an alarm event, and, if so, the type of alarm signal that will be generated. In other words, the security system of the present invention evaluates a detected trigger event or other sensor signal based on the learned information related to activity patterns and then determines the type of alarm, if any, that should be issued in response to the trigger event or other sensor signal.

Figure 3:
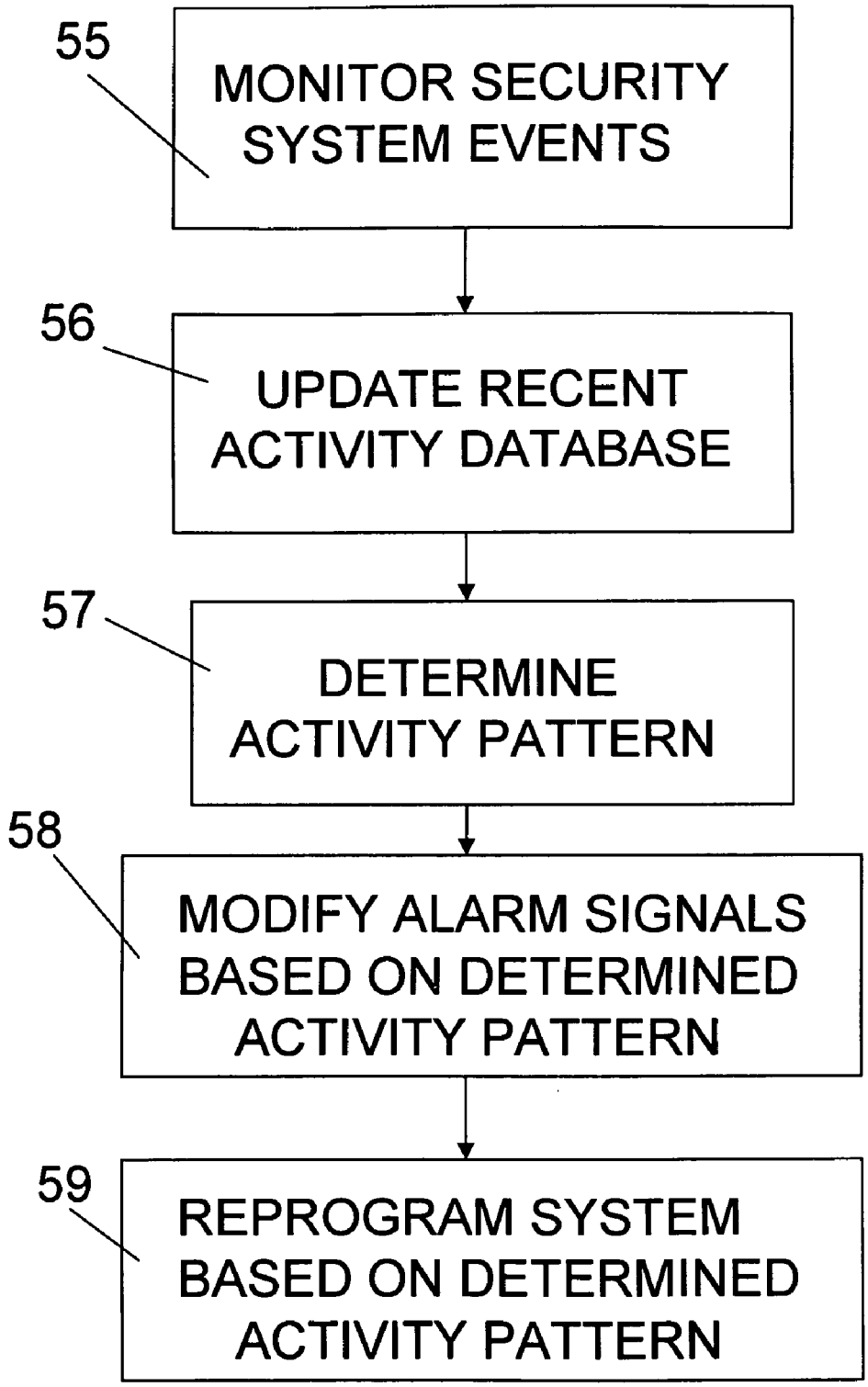
FIG. 3 is a block diagram illustrating steps performed by the security system to monitor security system events, update a recent activity database, and modify or reprogram operation of the security system based on a determined activity pattern.

FIG. 3 illustrates steps performed by the security system 10 and method of the present invention. As discussed above, the security system 10 monitors security system events as illustrated at block 55. Such events can be trigger events, alarm events, arm events, disarm events or any other events or activities. The security system 10 stores the activity information in a recent event database as illustrated at block 56. The security system 10 then analyzes the information in the recent activity database to determine activity patterns as illustrated at block 57. As discussed above, the recent activity database 53 stores time of day, day of week, and other information such as the particular zone in which a trigger event occurs. Therefore, for example, the system 10 may determine certain days of the week and/or times of the day that users have caused trigger events which subsequently caused false alarms or aborted alarms.

Next, the security system 10 modifies the type of alarm signals, if any, that are generated in response to trigger events based upon the determined activity pattern as illustrated at block 58. In an illustrated embodiment of the present invention, the system 10 may also automatically reprogram times when the security system is in an armed state, a disarmed state, or times in which entry and exit delays or dialer delays are used based upon the determined activity patterns as illustrated at block 59. The activity pattern data may also be used to reprogram cross-zoning alarm zones or patterns.

In an illustrative example, a timer may be set to disarm the system 10 at 7:00 a.m. on weekdays. If the system determines by analyzing the recent activity data in database 53 that many aborted alarms were caused by users and not intruders between 6:30 a.m. and 7:00 a.m. on Thursdays, the system 10 may automatically reprogram the system to switch to a disarmed state beginning at 6:30 a.m. instead of 7:00 a.m. on Thursdays. This may reduce false alarms.

When a trigger event occurs, the event is analyzed against the current acceptable activity pattern. If the detected trigger event is determined to not be an alarm event, then the trigger event and the time and day, day of the week, and security zone of occurrence is added to the recent event database 53. For example, a child walking downstairs in the middle of the night may accidentally trip an interior (instant alarm). When an arm event or disarm event occurs, the time of day and day of week is also added to the recent events database 53. This added information is then used in the next recalculation of the activity pattern.

Figure 4:
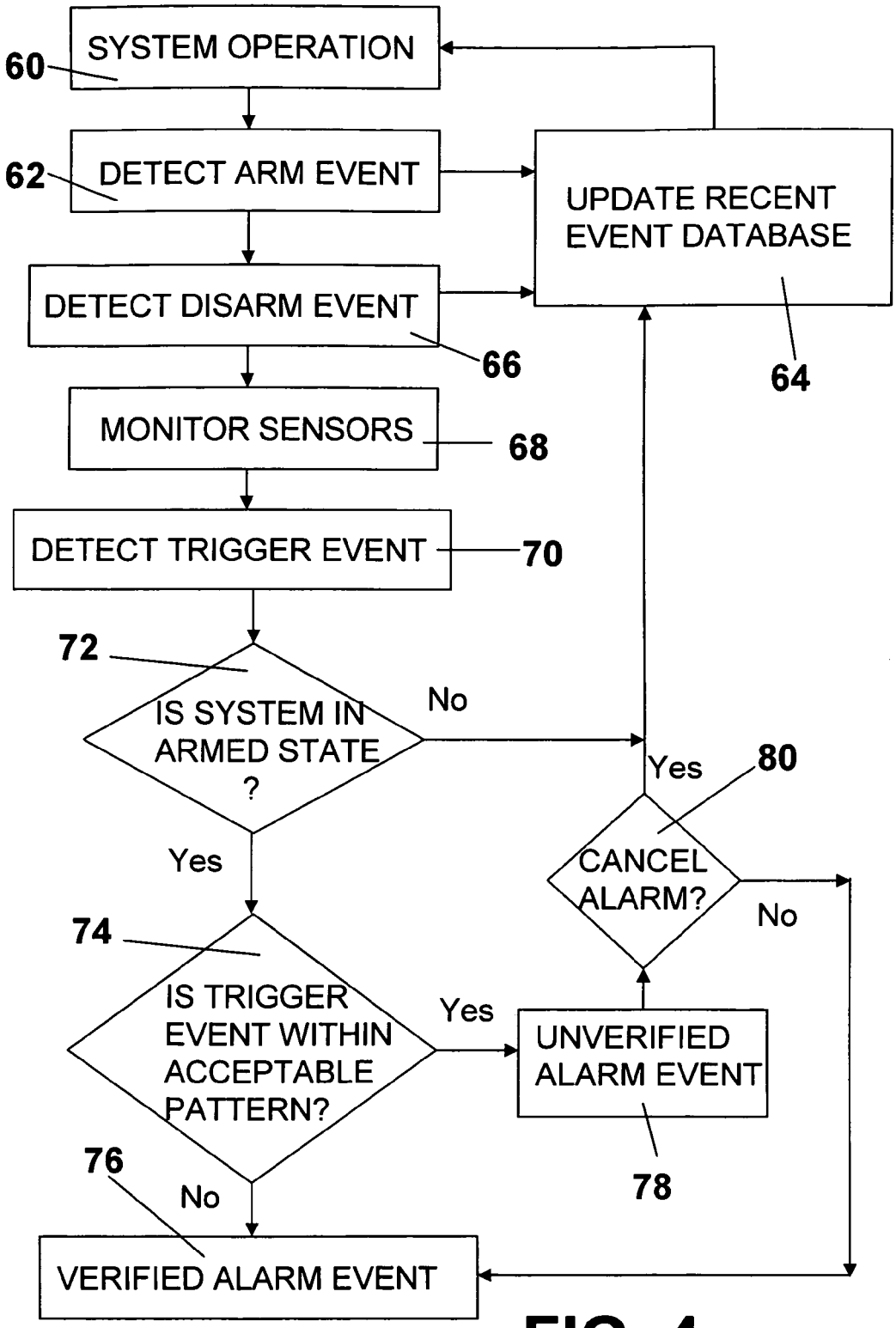
FIG. 4 is a flowchart illustrating steps performed by the security system to detect trigger events and determine a type of alarm, if any, to send in response to a detected trigger event.

An illustrated embodiment of the present invention is shown in more detail in FIG. 4. Security system operation is shown generally at block 60. When security system 10 detects an arm event at block 62 which places the security system 10 in an armed state, the system updates the recent event database 53 as illustrated at block 64. When the security system 10 detects a disarm event as illustrated at block 66 which places the system in disarmed state, system 10 also updates the recent event database 52 at block 64. For example, system 10 records the time of day and day of the week that the particular arm event or disarm event occurs.

Next, security system 10 monitors sensors 16 throughout the building 12 (or other area) as illustrated at block 68. When one of the sensors 16 detects a trigger event as illustrated at block 70, the system 10 determines whether the system is in a armed state as illustrated at block 72. If the system 10 is not in armed state, the particular trigger event is stored in the recent event database 53 as illustrated at block 64, but no alarm signal is generated. The system 10 then continues normal operation at block 60.

If the system is in an armed state at block 72, the system 10 determines whether the detected trigger event is within an acceptable activity pattern at block 74. As discussed above, the recent event database 53 is analyzed to determine activity patterns in which, for example, unverified alarm events are aborted by user or central station operator. If the particular detected trigger event is not within the acceptable activity pattern at block 74, a verified alarm event is issued as illustrated at block 76. The verified alarm event sends the alarm signal to a central station receiver such as a security company, fire station, or police station.

If the particular trigger event detected at block 70 is within an acceptable activity pattern as determined at block 74, then an unverified alarm event may be generated as illustrated at block 78. The unverified alarm event indicates that it is likely that the alarm was caused by a permitted user and not an intruder. The unverified alarm event typically provides a communication to the user or a system operator as discussed above to prompt the user or operator to cancel or abort the alarm as illustrated at block 80. For instance, the user may cancel the alarm by entering a passcode or other input into input device 48 on a user interface 18. Typically, if the unverified alarm is not cancelled within a predetermined period of time at block 80, a verified alarm event will be sent at block 76.

If the unverified alarm event is cancelled at block 80, the trigger event and subsequent cancellation are stored in the recent activity database 53 as illustrated at block 64. As discussed above, the type of trigger event, the particular zone, the time of day, the day of the week, or other desired information related to the trigger event can be stored in the recent event database 53. Storing trigger events which are later cancelled prior to issuance of an alarm signal assist the system of the present with determining an acceptable activity pattern and with reprogramming of certain features of the operation of the system 10 as discussed here.

Prior art systems typically require the system to be programmed with specific time windows to determine if a trigger event needs to be verified before issuing an alarm. The present system and method learns the activity patterns of the users of the system and automatically adjusts or reprograms the time windows based on the acceptable activity pattern. The present system and method also provides an opportunity to cancel instant alarms which may have been caused by the user.

The system and method of the present invention therefore provides a self-adjusting or learning system as opposed to a fixed and pre-programmed implementation. This provides an improved opportunity for a user or a central station operator to cancel a potential false alarm before a verified alarm event occurs, thereby reducing false alarms.

While the invention has been illustrated and described in detail in the drawings and foregoing description, the description is to be considered as illustrative and not restrictive in character. Variations and modifications exist within the scope and spirit of the present invention as described and defined herein and in the following claims.

What is claimed is:

1. A method of operating a security system comprising:

providing a plurality of sensors configured to sense trigger events and generate detection signals based thereon;

detecting a plurality of events that occur within the security system;

storing information related to the plurality of detected events in a recent activity database;

determining an activity pattern based on the stored information related to the plurality of detected events;

detecting a trigger event based on a detection signal from at least one of the plurality of sensors;

automatically programming times for arming and disarming the security system based at least in part on the determined activity pattern; and determining a type of alarm, if any, to issue in response to the detected trigger event based at least in part on the determined activity pattern.

2. The method of claim 1, wherein an unverified alarm is issued if the trigger event is within an acceptable activity pattern, the unverified alarm giving a user a predetermined time period to cancel the unverified alarm.

3. The method of claim 1, wherein a verified alarm is issued if the trigger event is not within an acceptable activity pattern.

4. The method of claim 3, wherein the verified alarm is sent to at least one of a central monitoring station, a security company, a fire station and a police station.

5. The method of claim 1, further comprising storing information related to the detected trigger event in the recent activity database.

6. The method of claim 5, wherein the information stored related to the trigger event includes a time of day and a day of the week that the trigger event occurred.

7. The method of claim 6, wherein the information stored related to the trigger event indicates a particular sensor which sensed the trigger event.

8. The method of claim 5, wherein the information stored related to the trigger event includes information regarding whether an alarm signal generated in response to the trigger event was cancelled within a predetermined period of time.

9. The method of claim 5, wherein the information stored related to the trigger event is used to determine an updated activity pattern.

10. The method of claim 1, wherein the storing step comprises storing information regarding arm events and disarm events in the recent activity database.

11. The method of claim 1, further comprising automatically programming at least one time window to determine whether an unverified alarm may be issued in response to a trigger event based at least in part on the determined activity pattern.

12. The method of claim 1, wherein the detected events include movement of the plurality of users within a plurality of zones of a secured area.

13. A security system comprising:

a plurality of sensors configured to sense trigger events and generate detection signals based thereon;

a controller configured to receive the detection signals from the plurality of sensors and selectively generate an alarm signal in response to the detection signals;

a recent activity database accessible by the controller, the recent activity database storing information related to a plurality of events occurring during operation of the security system, and wherein the controller is programmed to determine an activity pattern based on the information related to the plurality of events stored in recent activity database, to adjust programmed times for arming and disarming the security system automatically based at least in part on the determined activity pattern, and to determine a type of alarm, if any, to issue in response to a detected trigger event based at least in part on the determined activity pattern.

14. The system of claim 13, wherein the controller issues an unverified alarm if the detected trigger event is within an acceptable activity pattern, the unverified alarm giving a user a predetermined time period to cancel the unverified alarm.

15. The system of claim 13, wherein the controller issues a verified alarm if the detected trigger event is not within an acceptable activity pattern, the verified alarm being sent to at least one of a central monitoring station, a security company, a fire station and a police station.

16. The system of claim 13, further comprising means for storing information related to the detected trigger event in the recent activity database, the information stored related to the trigger event including a time of day and a day of the week that the trigger event occurred, and a particular sensor which sensed the trigger event.

17. The system of claim 16, wherein the information stored related to the trigger event includes information regarding whether an alarm signal generated in response to the trigger event was cancelled within a predetermined period of time.

18. The system of claim 13, further comprising means for automatically programming at least one time window to determine whether an unverified alarm may be issued in response to a trigger event based at least in part on the determined activity pattern.

19. A method of operating a security system comprising:

providing a plurality of sensors configured to sense trigger events and generate detection signals based thereon;

detecting a plurality of events that occur within the security system;

storing information related to the plurality of detected events in a recent activity database;

determining an activity pattern based on the stored information related to the plurality of detected events;

detecting a trigger event based on a detection signal from at least one of the plurality of sensors; and determining a type of alarm, if any, to issue in response to the detected trigger event based at least in part on the determined activity pattern, wherein an unverified alarm is issued if the trigger event is within an acceptable activity pattern, the unverified alarm giving a user a predetermined time period to cancel the unverified alarm, and wherein a verified alarm is issued if the trigger event is not within an acceptable activity pattern.

20. The method of claim 19, wherein the storing step comprises storing information regarding arm events and disarm events in the recent activity database.

* * * * *